US011355327B2

(12) United States Patent
Maccarrone et al.

(10) Patent No.: US 11,355,327 B2
(45) Date of Patent: Jun. 7, 2022

(54) ION PUMP SHIELD

(71) Applicant: Agilent Technologies, Inc., Santa Clara, CA (US)

(72) Inventors: Cristian Maccarrone, Turino (IT); Chiara Paolini, Grugliasco (IT); Enrica Carbonero, Cigliano (IT); Paolo Manassero, Turin (IT)

(73) Assignee: Agilent Technologies, Inc., Santa Clara, CA (US)

( * ) Notice: Subject to any disclaimer, the term of this patent is extended or adjusted under 35 U.S.C. 154(b) by 2 days.

(21) Appl. No.: 16/719,812

(22) Filed: Dec. 18, 2019

(65) Prior Publication Data

US 2020/0126776 A1 Apr. 23, 2020

Related U.S. Application Data

(63) Continuation-in-part of application No. 15/665,266, filed on Jul. 31, 2017, now Pat. No. 10,580,629.

(51) Int. Cl.
*H01J 41/12* (2006.01)

(52) U.S. Cl.
CPC ..... *H01J 41/12* (2013.01)

(58) Field of Classification Search
CPC ..... H01J 41/12–20; F04B 37/02; F04B 37/14
See application file for complete search history.

(56) References Cited

U.S. PATENT DOCUMENTS

| | | | | |
|---|---|---|---|---|
| 3,540,812 | A | 11/1970 | Henderson | |
| 4,631,002 | A | 12/1986 | Pierini | |
| 5,646,488 | A | 7/1997 | Warburton | |
| 6,411,023 | B1 | 6/2002 | Ogura et al. | |
| 7,718,983 | B2 | 5/2010 | Burtner | |
| 7,850,432 | B2 | 12/2010 | Clough et al. | |
| 9,960,026 | B1 | 5/2018 | Hughes | |
| 11,056,326 | B2 * | 7/2021 | Porcelli | F04B 37/14 |
| 2002/0159891 | A1 | 10/2002 | Shen | |
| 2008/0069701 | A1 * | 3/2008 | Clough | F04B 37/02 417/49 |
| 2014/0292186 | A1 | 10/2014 | Maccarrone et al. | |
| 2019/0051504 | A1 | 2/2019 | Porcelli | |
| 2019/0180969 | A1 | 6/2019 | Thierley | |

FOREIGN PATENT DOCUMENTS

| | | | | |
|---|---|---|---|---|
| DE | 102016101449 A1 * | 3/2016 | | H01J 41/20 |
| DE | 102016101449 A1 | 3/2016 | | |

* cited by examiner

*Primary Examiner* — Kenneth J Hansen
*Assistant Examiner* — Thomas Fink

(57) ABSTRACT

An ion pump with a housing enclosing an interior, a gas inlet having a through-hole extending into the interior of the ion pump, at least one cathode, at least one anode positioned in proximity to the at least one cathode, a magnet disposed on an opposite side of the at least one cathode from the anode, and a blocking shield disposed between the gas inlet and the at least one cathode. The blocking shield is electrically connected to the at least one anode. An associated method installs the blocking shield by inserting components of the blocking shield assembly through the gas inlet, and assembling (inside the interior of the ion pump) the inserted components to form the blocking shield.

14 Claims, 11 Drawing Sheets

ION PUMP SHIELD

RELATED APPLICATIONS

This application is a continuation-in-part and claims the benefit of U.S. patent application Ser. No. 15/665,266, filed Jul. 31, 2017, titled "ION PUMP SHIELD," the content of which is incorporated by reference herein in its entirety.

TECHNICAL FIELD

This invention relates generally to vacuum pumps and more particularly to improved ion pumps and their construction.

BACKGROUND

An ion pump (also referred to as a sputter ion pump) is a type of known vacuum capture pump capable of reaching pressures as low as $10^{-11}$ mbar under ideal conditions. Ion pumps do not mechanically pump gases out of a chamber, but rather function by converting gases within a chamber to solids that are then deposited on surfaces within the ion pump, as well as through physical sorption of gases (particularly noble gases) on surfaces within the ion pump. According to the law of ideal gases, the pressure inside of a fixed volume at a fixed temperature is proportionate to the number of gas molecules present. Therefore, by capturing gas molecules and converting or binding them to solids, the gas pressure inside the chamber is reduced. An ion pump is a device that ionizes gas within a vessel (to which the ion pump is attached) and employs a strong electrical potential, typically 3 kV to 7 kV, that allows the gas ions to accelerate into and be captured by a solid electrode and its residue.

An ion pump normally includes an anode formed from an array of close packed, axially symmetric (tubular) metal elements and a cathode surface normal to the axis of the tubular array and spaced apart from the anode. The cathode (s) and anode(s) are disposed within a hermetic sealed housing. The cathode is a chemically active, non-magnetic metal, typically titanium, vanadium, tantalum, or zirconium. The anode is frequently stainless steel. The cathode typically faces open ends of the tubular anodes.

An ion pump normally typically utilizes a static magnetic field in combination with the electric field inside the ion pump to enhance ionization of gasses inside the pump. In FIG. 1, a perspective view of an example of an implementation of a known ion pump 100 is shown.

The electric potential can be generated using a set of three electrodes: a ring 102 and two end-caps 104 and 106 between a magnet 108. In this example, the ring 102 is an anode element, such as a cylindrical anode of stainless steel, and the end-caps 104 and 106 are cathodes. For trapping of ions, the end-cap electrodes 104 and 106 can be kept at a negative potential relative to the cylindrical anode 102. This potential produces a saddle point which traps ions along the trap axial direction 110. The electric field causes ions to oscillate along the trap axis 110. The magnetic field in combination with the electric field causes charged particles to move in the radial plane 112 with a motion which traces out a helix.

In FIG. 2, a side-view of the ion pump 100 of FIG. 1 is shown in combination with the vessel 200 that has an inlet 202. The cathode plates 104 and 106 are shown positioned on both sides of one of the anode cylinders 102. It is appreciated that while only one anode cylinder 102 is shown for convenience, the description extends to a plurality of anode cylinders 102. Typically, the anode 102 is made of stainless steel, aluminum or other similar metals, which serves as a "gettering" material. A magnetic field 204 is oriented along the axis 206 of the anode 102. Electrons 208 are emitted from the cathodes 104 and 106 due to the action of an electric field 210 and, due to the presence of the magnetic field 204, the electrons 208 move in long helical trajectories 212 which improves the chances of collision with gas molecules 214 inside the ion pump 100 that are introduced via the inlet 202.

The usual result of a collision of a gas molecule 214 with an electron 208 is the creation of a positive ion 216 that is accelerated to some voltage potential by the anode voltage and moves almost directly in the direction 218 to the cathode 106. The influence of the magnetic field 204 on the ion is relatively small because of the ion's relatively large atomic mass compared to the electron mass.

Cathodes 104 and 106 may be of titanium (tantalum, other related alloys, or other getter metals). In the case of cathodes 104 and 106 being made of titanium, ions 216 impacting on the titanium cathode surface sputter titanium atoms (or molecules) 220 in a direction 222 away from the cathode 106, thereby forming a getter film on the neighboring surfaces and stable chemical compounds with the reactive or "getterable" gas particles (e.g. CO, $CO_2$, $H_2$, $N_2$, $O_2$). This pumping effect is very selective for the different types of gas molecules 214 and is the dominating effect with ion pumps. The number of sputtered titanium molecules 220 is proportional to the pressure inside the ion pump. The sputtering rate depends on the ratio of the mass of the bombarding ions 216 and the mass of the cathode material 220.

In an example of operation, electrons 208 are temporarily stored in the anode region 224 of the ion trap 100. These electrons 208 ionize incoming gas atoms and molecules 214. The ions 216 are accelerated to strike the chemically active cathodes 104 and 106. On impact, the accelerated ions 216 will either become buried within the cathode 104 and 106 or sputter cathode material 220 onto the walls 226 of the ion pump. The freshly sputtered chemically active cathode material 220 acts as a getter that then evacuates the gas by both chemisorption and physisorption resulting in a net pumping action.

Both the pumping rate and capacity of such capture methods are dependent on the specific gas molecules 214 being collected and the cathode material absorbing it. Some gas molecules 214, such as carbon monoxide, will chemically bind to the surface of a cathode material. Others, such as hydrogen, will diffuse into the metallic structure.

U.S. Pat. No. 7,850,432 (the entire contents of which are incorporated herein by reference) describes various ion pump designs having a gastight housing with a gas inlet that is attached to a vacuum chamber and having an anode, a cathode, and a complex blocking shield assembly.

SUMMARY

In one embodiment of the invention, there is provided an ion pump comprising a housing enclosing an interior, a gas inlet having a through-hole extending into the interior of the ion pump, at least one cathode, at least one anode positioned in proximity to the at least one cathode, a magnet disposed on an opposite side of the at least one cathode from the at least one anode, and a blocking shield disposed between the gas inlet and the at least one cathode, and electrically connected to the at least one anode.

In one embodiment of the invention, there is provided a blocking shield for installation in an ion pump having a housing enclosing an interior, a gas inlet having a through-hole extending into the interior of the ion pump, at least one cathode, and at least one anode. The blocking shield comprises an assembly comprising a first top plate member having a first upper surface, a second top plate member adjoining the first top plate member, the second top plate member having a second upper surface, a base for holding the assembly in place, and at least one support connecting at least one of the first top plate member and the second top plate member to the base. The first top plate member and the second top plate have lateral and transverse extents which occlude the at least one cathode from a perspective of a through-hole of the gas inlet.

In one embodiment of the invention, there is provided a method for installing a blocking shield in an ion pump having a housing enclosing an interior, a gas inlet having a through-hole extending into the interior of the ion pump, at least one cathode, and at least one anode. In this method, the blocking shield comprises components having respective dimensions sized such that all components have clearance for passage through a through-hole of the gas inlet. The method inserts the components of the blocking shield through the gas inlet, and assembles (inside the interior of the ion pump) the inserted components to form the blocking shield.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. It is to be understood that both the foregoing general description of the invention and the following detailed description are exemplary, but are not restrictive of the invention.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

The present invention addresses the problem of particles emitted from an ion pump during its operation. Such particles include primary charged particles, secondary charged particles, neutrals, X-ray and visible light (or other photons), and titanium atoms (or other metal atoms) sputtered from the cathodes. Emissions of these particles from the ion pump can adversely impact analytical instruments such as scanning electron microscopes where the emissions can contribute background noise to the image. Similar problems occur for transmission electron microscopes and focused ion beam machines as well as high energy physics machines like particle accelerators. The inventors have developed, through testing and modeling and comparison to prior art systems, an effective and simple shield for blocking such particles while minimizing the conductance loss, and therefore preserving ion pump performance.

Figure 1:
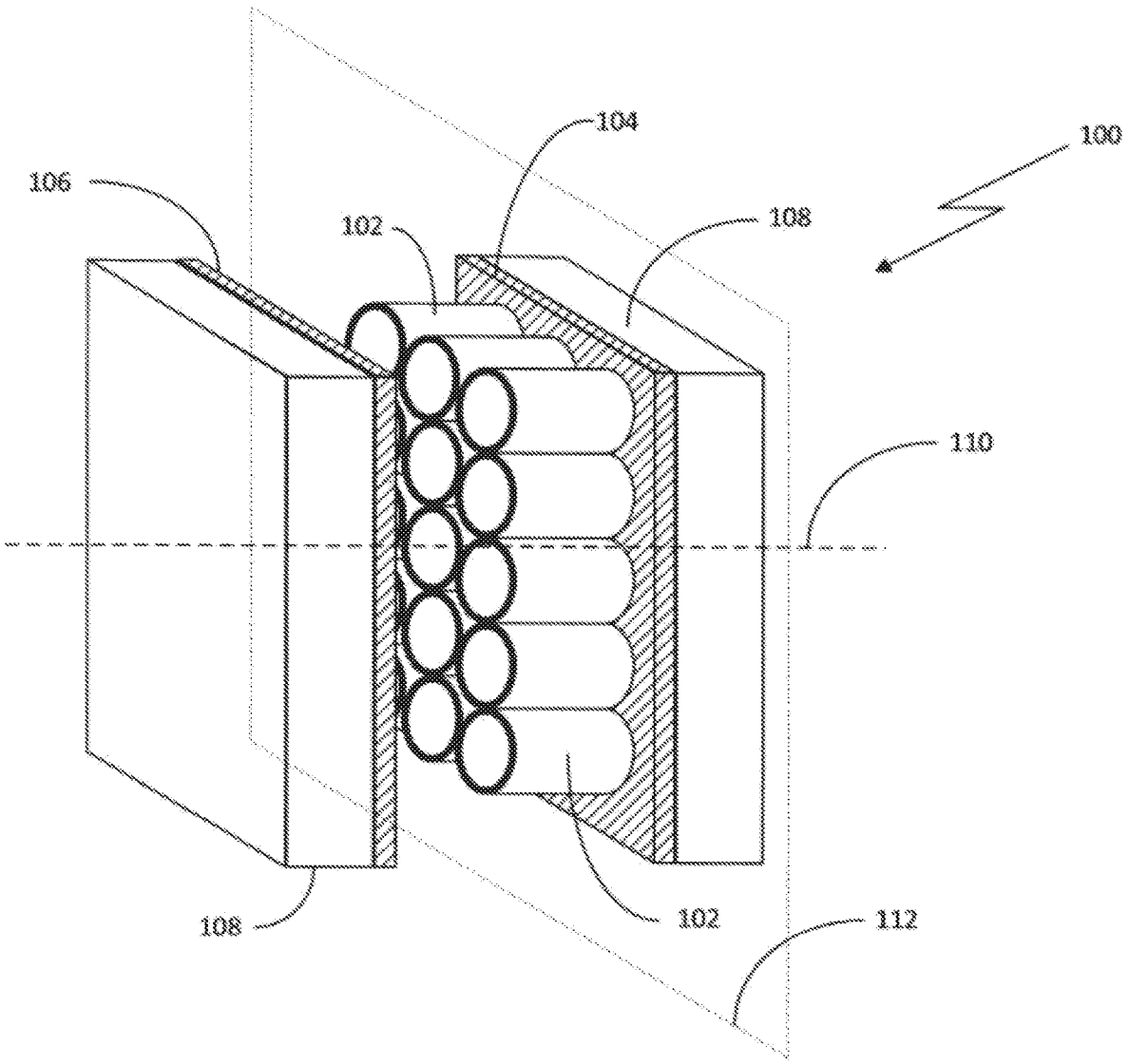
FIG. 1 Prior Art
FIG. 1 is a perspective view of an example of an implementation of an ion pump.
Figure 2:
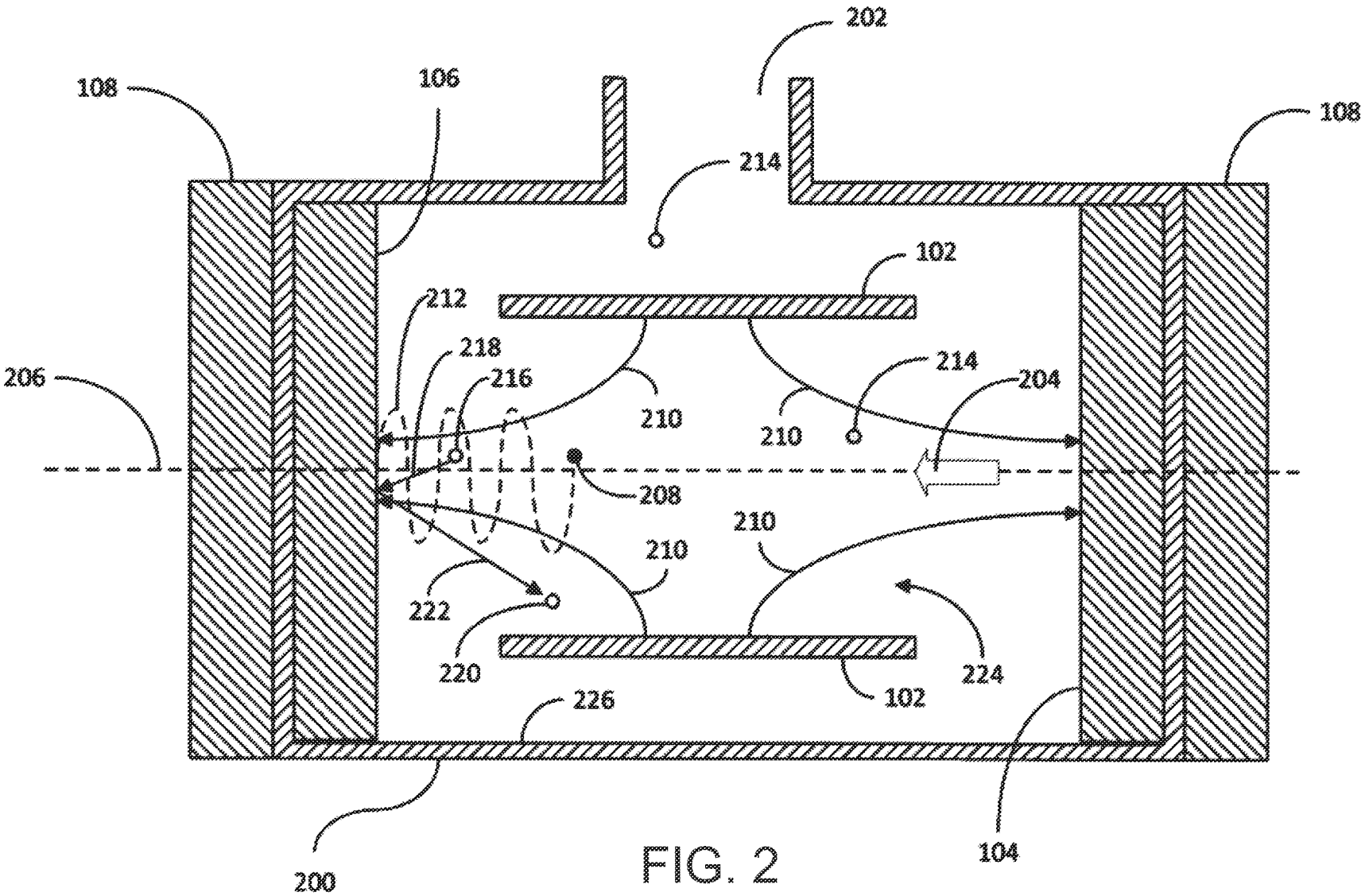
FIG. 2 Prior Art
FIG. 2 is a side view of the ion pump of FIG. 1 in combination with a vessel that has an inlet.
Figure 3A:
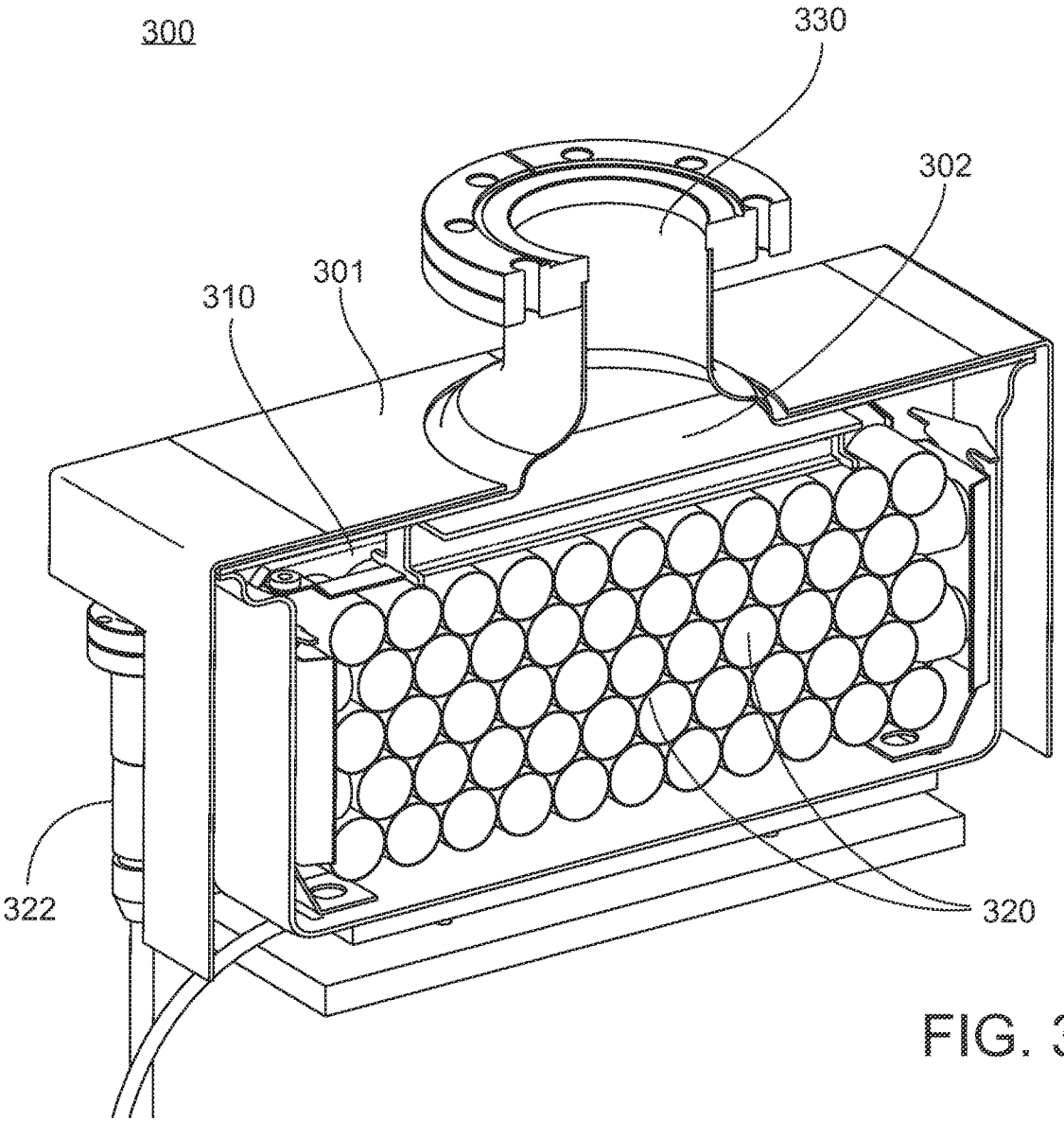
FIG. 3A is a perspective view of an example of an ion pump with a blocking shield assembly in accordance with the invention.

FIG. 3A is a perspective view of an ion pump 300 with a blocking shield assembly installed on ion pump 300 according to an embodiment of the present invention. Ion pump 300 has a housing 301 enclosing an interior of the ion pump 300. The blocking shield assembly includes a blocking shield 302 that forms a blocking relationship with respect to at least one cathode 310. As shown in FIG. 3A, blocking shield 302 is disposed underneath a gas inlet 330 and above cathode 310, depicted here illustratively in the shape of a plate. An electrical feedthrough 322 provides voltages to the cathode 310 or anode 320. Cathode 310 is disposed parallel to the magnet (not shown in this view). As shown in FIG. 3A, anode 320 having the construction of one or more hollow cylinders is disposed in relation to the cathode 310 as in a similar manner as used in conventional ion pumps with a longitudinal axis of the cylinders extending normal (or substantially normal e.g., within 10° of normal) to cathode 310. It will be understood that the ion pump 300 may include another cathode, which from the perspective of FIG. 3A may be located in front of the anode 320, and which has been removed to enable the anode 320 to be visible in FIG. 3A.

Figure 3B:
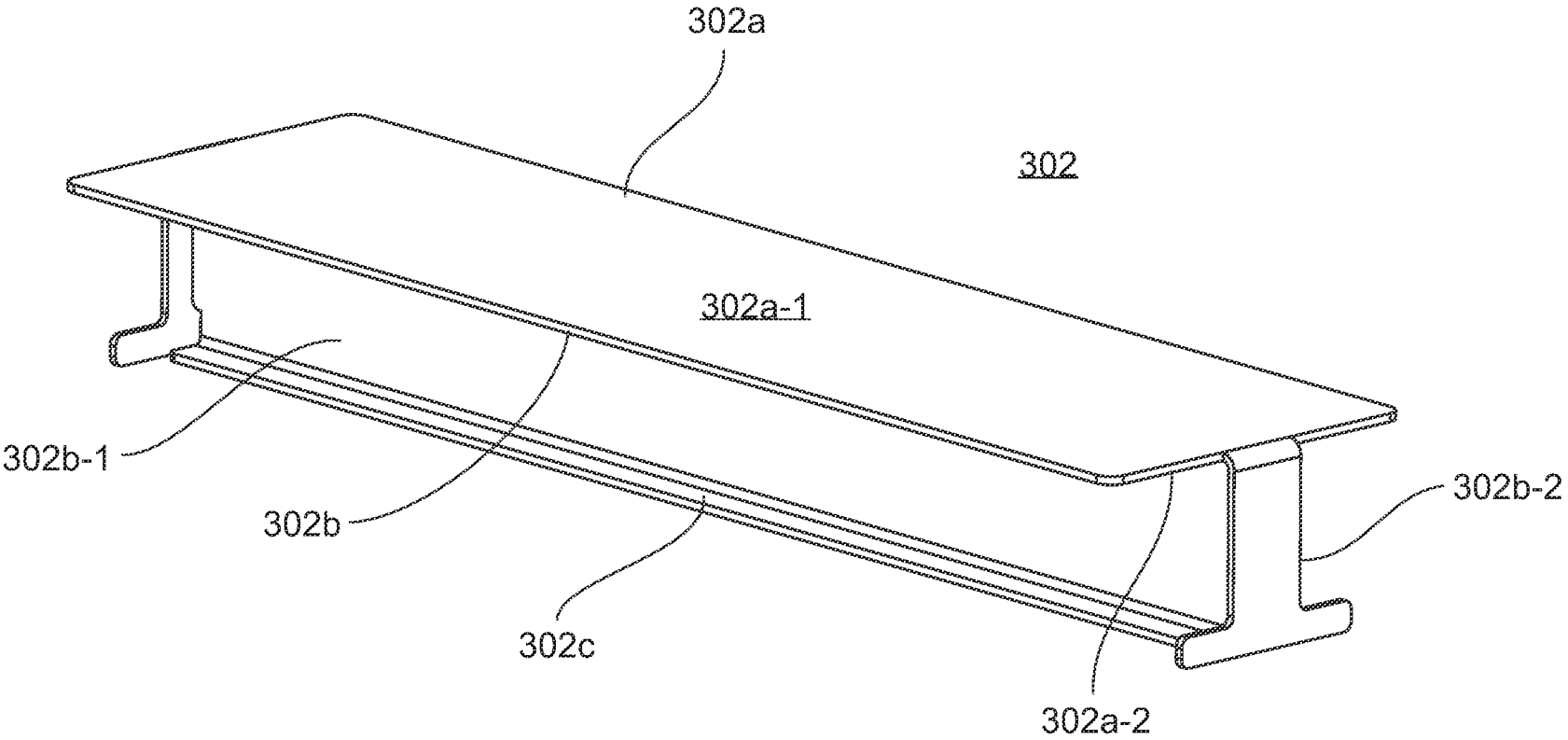
FIG. 3B is a perspective view of an example of a blocking shield in accordance with the invention.

The blocking shield assembly in one embodiment of the invention is arranged in a plane parallel or generally parallel to the longitudinal axis of the cylinders. The embodiment of the blocking shield 302 depicted in FIG. 3B shows top plate 302*a* of blocking shield 302 to be generally planar. In one embodiment of the invention, top plate 302*a* of blocking shield 302 has a surface which extends laterally or transversely in the plane without angular deviations from the plane. In one embodiment, top plate 302*a* of blocking shield 302 has no angled parts, and is fixed in place in a plane that is parallel or generally parallel to the longitudinal axis of the cylinders of anode 320. That is, top plate 302*a* is not disposed at a substantial angular displacement therefrom. That is, top plate 302*a* is disposed is not more than 15 degrees from, or not more than 10 degrees from, or not more than 5 degrees from, or not more than 2 degrees from the plane parallel or generally parallel to the longitudinal axis of anodes 320. However, in other embodiments, different shapes and geometries could be used.

FIG. 3B shows the one-piece construction of blocking shield 302 where the blocking shield has a "desk" or "desk top" shape with top plate 302*a*, a vertically extending support 302*b*, and a base 302*c*. Top plate 302*a* has an upper surface 302*a*-1 which faces gas inlet 333 and a corresponding lower surface 302*a*-2. Blocking shield 302 is configured by its geometry and the laterally extending distances of top plates 302*a* to block direct transmission of particle emissions from cathode 310 to gas inlet 330. In this design, the underside surface 302*a*-2 of top plate 302*a* and the vertical wall(s) 302*b*-1, 302*b*-2 of support 302*b* serve as a block against particles, especially Ti atoms (or other materials of cathode 310), that are sputtered from the surface of the cathode during operation of the ion pump 300. The lateral extent of the blocking shield 302 is discussed below.

During fabrication of ion pump 300, the base 302*c* in one embodiment is welded to the hollow tubes forming anode 320, thereby holding blocking shield 302 in place. While other materials can be used for the blocking shield 302 such as copper or aluminum, stainless steel is considered a material of choice for the blocking shield 302 because anode 320 is typically stainless steel. Other techniques could be used to hold blocking shield 302 in place, including mechanical fasteners and brazing. Mechanical fasteners permit a variety of materials to be used for the blocking shield such as the materials noted above. In one embodiment of the invention, blocking shield 302 is positively biased. In another embodiment of the invention, blocking shield 302 is electrically connected to anode 320.

Accordingly, while the blocking shield assembly in one embodiment of the invention is arranged in a plane parallel or generally parallel to the longitudinal axis of the cylinders, other embodiments with different shapes and geometries could be used including angled plates, provided the blocking shield assembly both optically covers line of sight to cathode 310 from the gas inlet 330 perspective and is connected electrically to anode 320, or otherwise positively biased.

Figure 4:
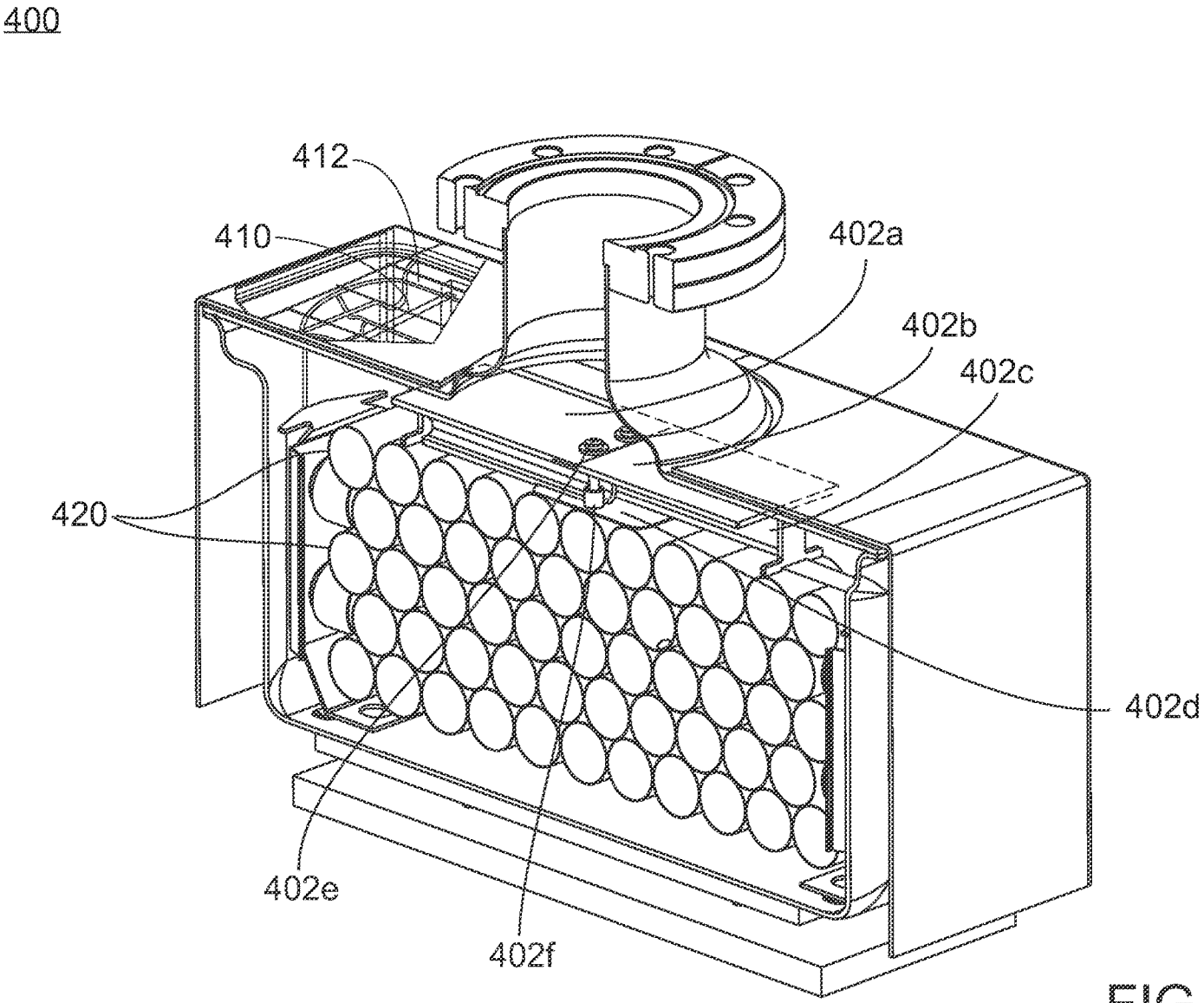
FIG. 4 is perspective view of an example of an ion pump with a multi-piece blocking shield assembly in accordance with the invention.

In one embodiment of the invention, as shown in FIG. 4, the blocking shield of an ion pump 400 can be formed of multiple pieces. In this embodiment, blocking shield 402 has top plates 402*a*, 402*b* which are arranged in a plane parallel or generally parallel to the longitudinal axis of the cylinders of anode 420. Blocking shield 402 is configured by its geometry and the laterally extending distances of top plates 402*a*, 402*b* to block direct transmission of particle emissions from cathode 410 to gas inlet 430. The embodiment of the blocking shield 402 depicted in FIG. 4 shows top plates 402*a*, 402*b* which are generally planar, however in other embodiments different shapes and geometries could be used, which extend in a plane parallel to the longitudinal axis of anode 420. When top plates 402*a*, 402*b* are used, the invention permits retrofitting of the blocking shield assembly into an existing ion pump, as detailed below.

Figure 5:
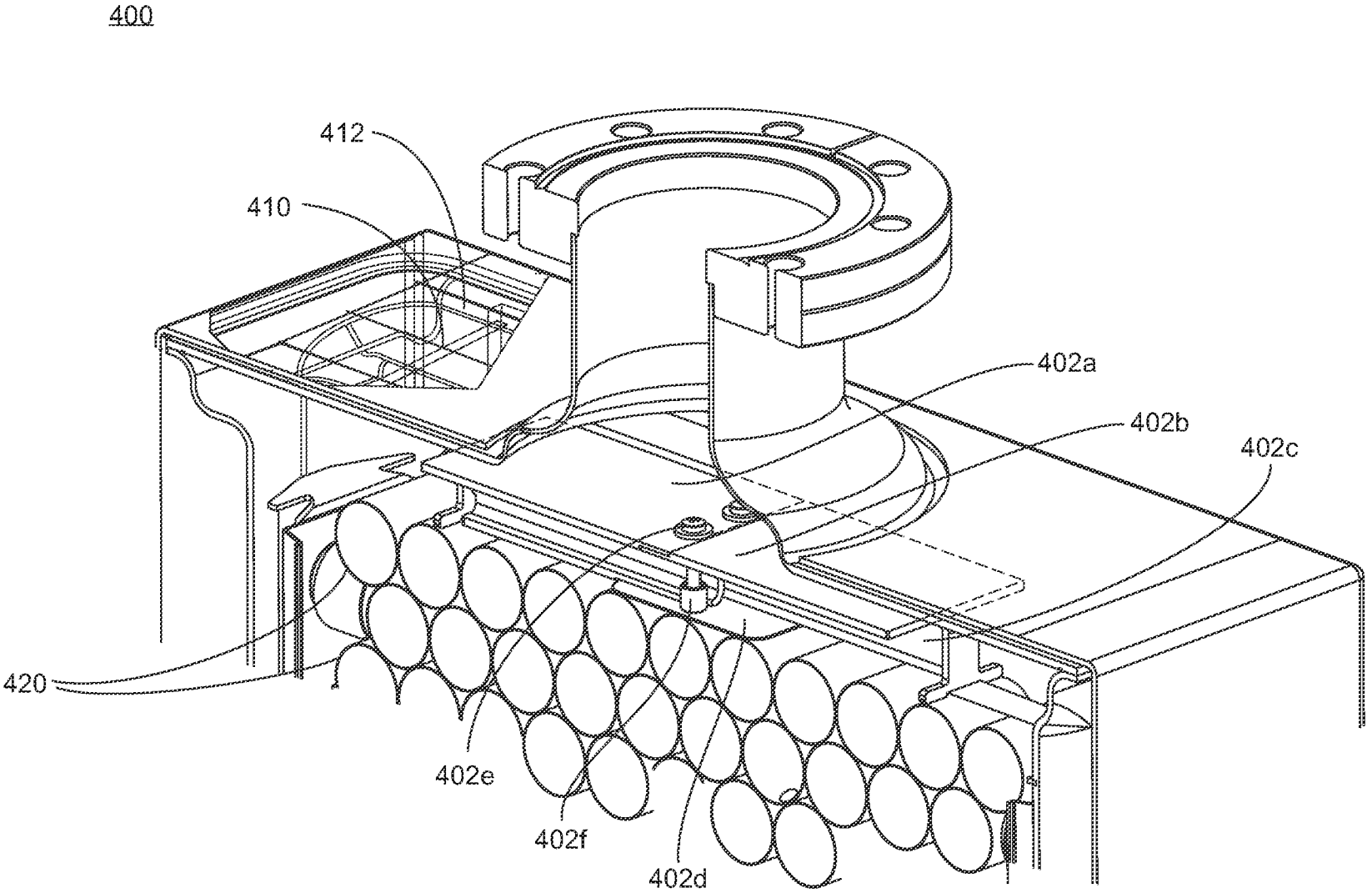
FIG. 5 is an enlarged view of FIG. 4.

An enlarged view of the blocking shield 402 is shown in FIG. 5. This view depicts one embodiment of the invention by which top plates 402*a*, 402*b* are held together. As shown, extending down from top plates 402*a*, 402*b* are supports 402*c* which connect top plates 402*a*, 402*b* to bottom plate 402*d*. Screws 402*e* tie the top plates 402*a*, 402*b* to the bottom plate 402*d* via threaded posts 402*f* fixed to bottom plate 402*d*.

While shown as top plates 402*a*, 402*b*, blocking shield 402 could be constructed of more than two top plates. In one embodiment of the invention, top plates 402*a*, 402*b* forming the blocking shield 402 have no angled parts, and are fixed in place in a plane that is parallel or generally parallel to the longitudinal axis of anode cylinders 420, and not disposed at a substantial angular displacement therefrom. That is top plates 402*a*, 402*b* are disposed not more than 15 degrees from, or not more than 10 degrees from, or not more than 5 degrees from, or not more than 2 degrees from the plane parallel or generally parallel to the longitudinal axis of the cylinders of anode 420. In one embodiment of the invention, the blocking shield 402 has a surface which extends laterally or transversely in the plane without angular deviations from the plane.

In one embodiment of the invention, bottom plate 402*d* is inserted through gas inlet 430 and fixed in place by mechanical connections to the ion pump housing 401 or other stationary part of the ion pump 400. In one embodiment of the invention, bottom plate 402*d* preexists inside ion pump housing 401 at the time of complete assembly of the ion pump 400, and the remaining pieces 402*a*, 402*b*, and 402*c* can later be added to the ion pump 400. At the time of insertion, top plate 402*a* with its support 402*c* and then top plate 402*b* with its support 402*c* are inserted through gas inlet 430. Once inside housing 401 of the ion pump 400, top plates 402*a*, 402*b* are fitted together such as by matching grooves or slots or dovetails or other fitting devices known in the art. Once top plates 402*a*, 402*b* are fitted together, screws 402*e* are inserted through holes in top plates 402*a*, 402*b* and screwed into threaded posts 402*f*.

In one embodiment of the invention, the blocking shield 302 or 402 is polarized at the same voltage of the anode (2 to 8 kV typically), for example by welding of the blocking shield 302 or 402 to anode 320 or 420. This positive polarization increases the effectiveness of the blocking shield 302 or 402 to prevent charged particles from exiting the ion pump 300 or 400. Due to the electrical attraction of electrons towards the blocking shield 302 or 402 and/or ions towards housing 301 or 401 (at ground potential), an "electrical field shielding effect" shields the gas inlet 330 or 430 serving to stop more charged particles from exiting the ion pump 300 or 400 than would have been expected from a simple geometric block shielding the cathode 310 or 410. Accordingly, smaller physical shield dimensions can be used in the invention than would be expected from a top view where the extent of the blocking shield 302 or 402 geometrically obscured a view of cathode 310 or 410 (see discussion below). In one embodiment of the invention, the reduced lateral dimension of blocking shield 302 or 402 helps to preserve the pumping conductance of the ion pump 300 or 400 and the pumping speed efficiency without a compromise in the shielding effect because of the reduced lateral dimension (or transverse dimension). Regardless of the shielding effect, neutral particles such as titanium which may be sputtered from the cathode 310 or 410 will be blocked from exiting the ion pump by the physical block the blocking shield 302 or 402 represents. Accordingly, the blocking shield 302 or 402 can block both charged and neutral particles, simply by imposing an obstruction in the line of sight of both charged and neutral particles (physical trajectory of motion). Additionally, in the case of positively charged particles (gas ions), the blocking shield serves as a "repeller" or "'deflector" of the ions.

In another embodiment, the blocking shield 302 or 402 may be attached to the cathode 310 or 410 (e.g., to at least one of the cathode plates) instead of the anode 320 or 420, again by appropriate means such as welding, mechanical fastening, etc. In such embodiment, the blocking shield 302 or 402 may be energized at the same voltage potential as the cathode 310 or 410, which may be electrically grounded or have a voltage magnitude more negative than the anode 320 or 420. In such embodiment, the blocking shield 302 or 402 is again effective for blocking the trajectories of both neutral and charged particles in directions into the gas inlet 330 or 430, thereby preventing such particles from exiting the ion pump 300 or 400. In such embodiment, depending on the polarity and magnitude of the voltage potential applied to the blocking shield 302 or 402, it may attract positive ions and repel electrons.

The ion pump design shown in FIGS. 3A, 3B, and 4-7 is that of diode ion pump configuration. However, the invention is not limited to diode ion pumps. The blocking shields described above can be used for other ion pump configurations such as for example a triode ion pump configuration or a star cell ion pump configuration. Generally, pumping noble gases does not pose a problem for an ion pump. However, when considerable amounts of noble gases need to be pumped, a pump of the triode configuration is often used. In the triode pump configuration, the cathode is at negative potential and built with slits that permit grazing incidence sputtering. The star cell configuration is efficient at pumping both noble gases and hydrogen. In the star cell configuration as described in U.S. Pat. No. 4,631,002 (the entire contents of which are incorporated herein by reference), the cathodes have a plurality of areas composed of a plurality of inwardly extending blades, each area having the appearance of a star as the inwardly extending blades are disposed radially. In the triode ion pump configuration or the star cell ion pump configuration, the blocking shield would be disposed between cathode and inlet to effectively block charged particles from exiting the ion pump.

Figure 6:
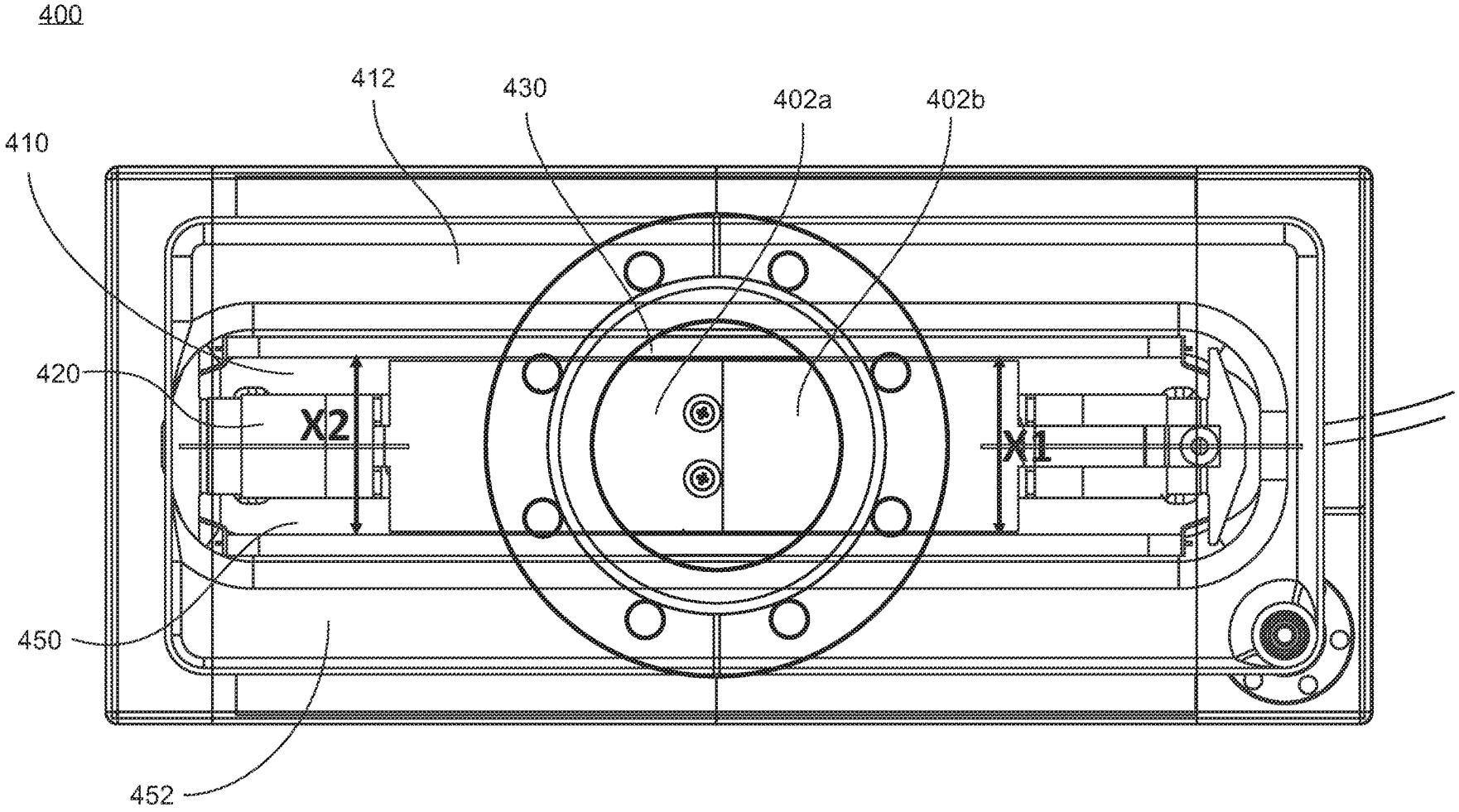
FIG. 6 is a top view of the blocking shield assembly installed on the ion pump of FIG. 4.

FIG. 6 is a top view of the blocking shield assembly of the present invention installed on ion pump 400. As shown in FIG. 6 and in one embodiment of the invention, the lateral extent of the top plates 402*a*, 402*b* or the lateral extent of blocking shield 402 covers or occludes the cathode 410 such that, when viewed through the hole of inlet 430 cathode plate 410 is hidden. Shown in FIG. 6 are cathode 450 and magnet 452 disposed opposite cathode 410 and magnet 412 with the intervening anode 420. Accordingly, in one embodiment of the invention, the blocking shield 402 is disposed between gas inlet 430 and cathode 410, and extends in a plane that is substantially parallel to the longitudinal axis of the one or more anodes 420 (i.e., the longitudinal axis of anode cylinders 420) to occlude the cathode 410 from a perspective of the through-hole. As also evident from FIG. 6 and other drawing figures, the blocking shield 402 (or 302) additionally or alternatively occludes the anode(s) 420 from the perspective of the through-hole. Correspondingly, any emission such as the above noted primary charged particles, secondary charged particles, neutrals such as titanium sputtered from the cathodes 410, X-ray and visible light, and/or ions are blocked from leaving the ion pump 400 and are not emitted from the hole in inlet 430.

In one embodiment of the invention, the lateral extent of the top plates 402*a*, 402*b* or the lateral extent of blocking shield 402 in a direction of the longitudinal axis of anode cylinders 420 is not limited to only that necessary to cover the cathode 410. In one embodiment of the invention, the laterally extending direction X1 as shown in FIG. 6 ranges from 80% to 120% of the cathode-to-cathode distance X2. The ranges smaller than 100% (e.g., 85 to 99%) can shield effectively because of the "electrical field shielding effect" discussed above. In one embodiment of the invention, the reduced dimensions of the blocking shield 402 permit the blocking shield 402 (i.e., its components) to be inserted/installed through the gas inlet 430 (as detailed below).

Figure 7:
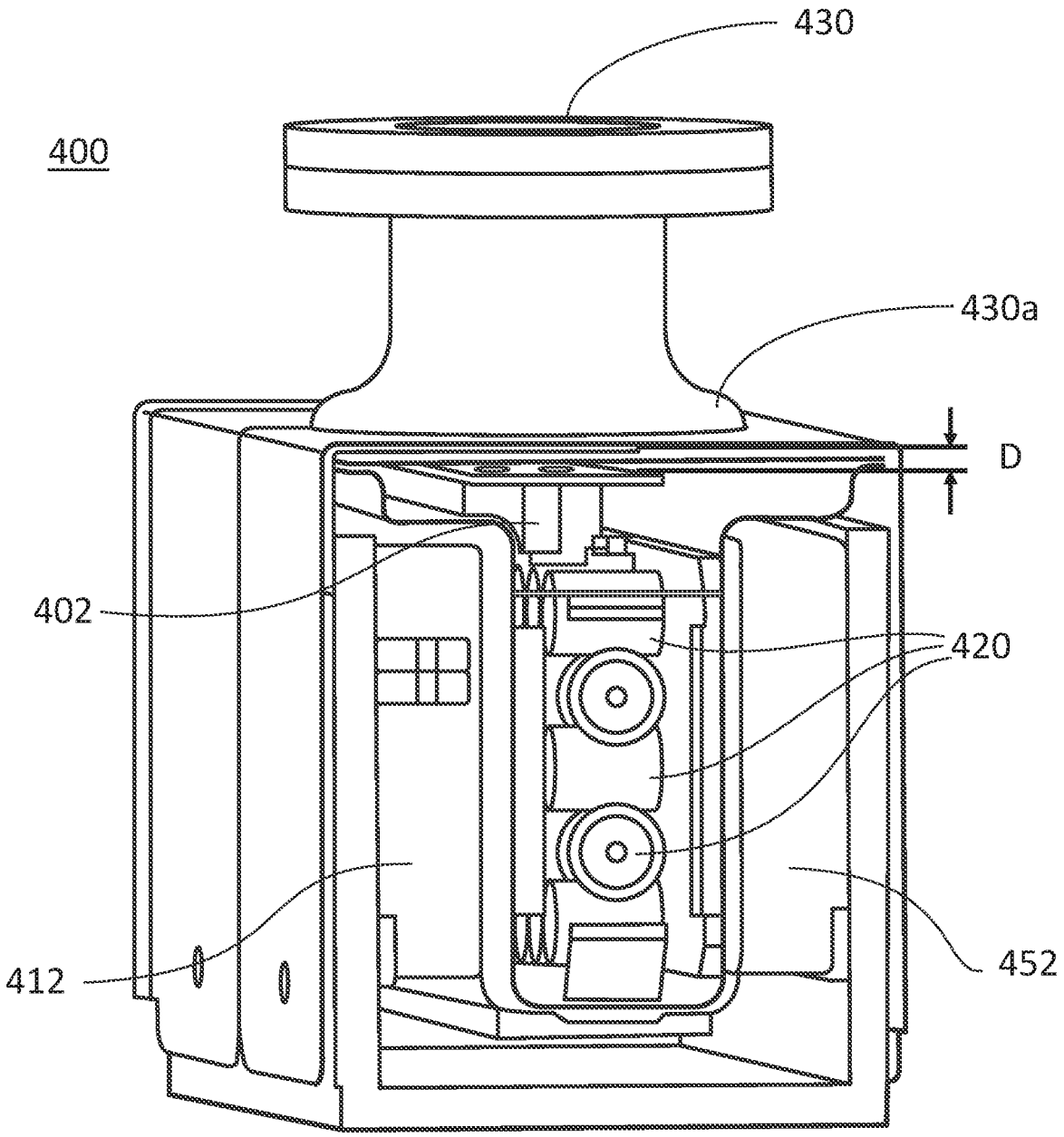
FIG. 7 is a perspective view of the ion pump of FIG. 4 showing the separation of the blocking from the base of the gas inlet.

FIG. 7 is a side view of ion pump 400 showing the separation of blocking shield 402 from the base 430*a* of gas inlet 430. In one embodiment of the invention, in a feature for maximizing conductance, a separation distance D between top plates 402*a*, 402*b* and the base 430*a* of gas inlet 430 is at least 0.5 cm, or at least 1 cm, or at least 2 cm, or at least 5 cm, including intervening distances and not exceeding 50 cm. This separation ensures that the ion pump 400 has a suitable conductance.

In one embodiment of the invention, the surface of the blocking shield 402 can be coated with or made of a getter material (to provide additional pumping speed) or it can be coated in strips of the getter materials. Getter materials suitable for the invention include metals or alloys comprising at least 30% of one or more of titanium, zirconium, and yttrium. Other getter materials can be aluminum (pure aluminum), tantalum, copper, vanadium, and alloys and mixtures thereof. The use of these materials is described DE 102016101449. The entirety of the contents of DE 102016101449 is incorporated herein by reference.

Figure 8:
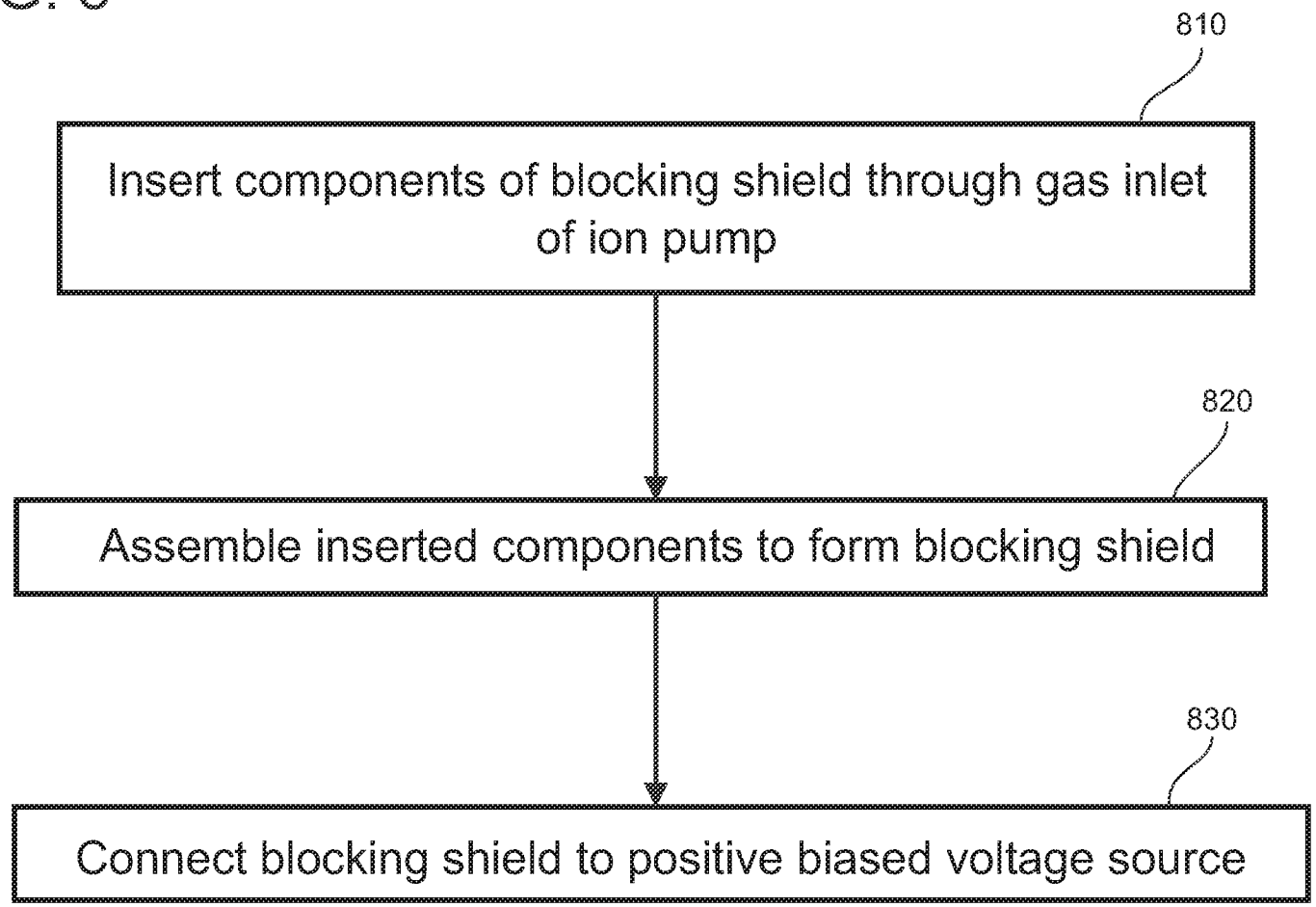
FIG. 8 is a flow chart depicting an installation method of the invention.

FIG. 8 is a flow chart of an associated method for installing the above-described blocking shield. At step 810, components of the blocking shield are inserted through the gas inlet. The components have respective dimensions sized such that all components have clearance for passage through a through-hole of gas inlet 430. As noted, above, especially (but not always) because of the electrical-field shielding effect, the reduced dimensions of the blocking shield 402 facilitate insertion of the components of the blocking shield 402 through the gas inlet 430. At step 820, inside the interior of the ion pump, the inserted components are assembled to form the blocking shield. Details of how the components fit together were detailed above. At optional step 830, the assembled blocking shield is electrically connected to a positively-biased voltage source. For example, the assembled blocking shield may be electrically connected to the one or more anodes.

EXEMPLARY EMBODIMENTS

Exemplary embodiments provided in accordance with the presently disclosed subject matter include, but are not limited to, the following:

1. An ion pump comprising:

a housing enclosing an interior;

a gas inlet having a through-hole extending into the interior of the ion pump;

at least one cathode;

at least one anode positioned in proximity to the at least one cathode;

a magnet disposed on an opposite side of the at least one cathode from the at least one anode; and a blocking shield disposed between the gas inlet and the cathode, and electrically connected to the at least one anode.

2. The ion pump of embodiment 1, wherein the blocking shield has a surface which extends laterally or transversely in a plane without angular deviations from the plane.

3. The ion pump of embodiments 1 or 2, wherein the blocking shield is positively biased by the electrical connection to the anode.

4. The ion pump of embodiment 1 or 2 or 3, wherein the blocking shield extends in a plane that is substantially parallel to a longitudinal axis of the anode.

5. The ion pump of embodiment 3, wherein the blocking shield comprises an electrical-field shield deflecting particles emitted from the at least one cathode.

6. The ion pump of embodiment 3, wherein the blocking shield comprises a solid shield.

7. The ion pump of any of the embodiments 1-6, wherein the at least one cathode comprises a) a first cathode and b) a second cathode, the at least one anode are disposed in between the first cathode and the second cathode, the first cathode and a second cathode have respective back-side surfaces opposite the at least one anode, with the back-side surfaces of the first cathode and a second cathode separated from each other by a distance D; and the blocking shield has a lateral extent in the longitudinal direction that is at least 80% of the distance D, or at least 90% of the distance D, or at least 95% of the distance D, or at least 100% of the distance D.

8. The ion pump of any of the embodiments 1-7, wherein the blocking shield has a transverse extent across the longitudinal direction that is at least 80% of a diameter of the through-hole, or at least 90% of a diameter of the through-hole, at least 95% of a diameter of the through-hole, at least 100% of a diameter of the through-hole.

9. The ion pump of any of the embodiments 1-8, wherein the blocking shield extends in a plane inside the ion pump, and the plane that is substantially parallel to the longitudinal axis of the at least one anode is disposed not more than 15 degrees from, not more than 10 degrees from, not more than 5 degrees from, or not more than 2 degrees from-a plane that is parallel to the longitudinal axis of at least one anode.

10. The ion pump of any of the embodiments 1-9, wherein the blocking shield comprises an assembly which once assembled forms the blocking shield facing the gas inlet.

11. The ion pump of any of the embodiments 1-10, wherein the assembly comprises:

a first top plate member having a first upper surface;

a second top plate member adjoining the first top plate member, the second top plate member having a second upper surface, a base for holding the assembly in place; and at least one support connecting at least one of the first top plate member and the second top plate member to the base.

12. The ion pump of embodiment 11, wherein respective dimensions of the first top plate member, the second top plate member, the base, and the support are sized such that all of the first top plate member, the second top plate member, the base, and the support have clearance for passage through the through-hole.

13. The ion pump of embodiment 11, wherein a lateral width of the first top plate member is greater than a lateral width of the base.

14. A blocking shield for installation in an ion pump (including any of the ion pumps set forth in any of the embodiments 1-13 above) having a housing enclosing an interior, a gas inlet having a through-hole extending into the interior of the ion pump, at least one cathode, at least one anode, the blocking shield comprising:

an assembly comprising, a first top plate member having a first upper surface, a second top plate member adjoining the first top plate member, the second top plate member having a second upper surface, a base for holding the assembly in place, and at least one support connecting at least one of the first top plate member and the second top plate member to the base; and the first top plate member and the second top plate having lateral and transverse extents which occlude the at least one cathode from a perspective of a through-hole of the gas inlet.

15. The shield of embodiment 14, wherein the blocking shield is configured to positively biased or grounded.

16. The shield of embodiment 15, wherein the blocking shield is configured to be electrically connected to the at least one anode.

17. The shield of embodiment 15, wherein the blocking shield comprises an electrical-field shield deflecting particles emitted from the at least one cathode.

18. A method for installing a blocking shield in an ion pump (including any of the ion pumps set forth in any of the embodiments 1-13 above) having a housing enclosing an interior, a gas inlet having a through-hole extending into the interior of the ion pump, at least one cathode, at least one anode, the blocking shield comprising components having respective dimensions sized such that all components have clearance for passage through a through-hole of the gas inlet, the method comprising:

inserting the components of the blocking shield through the gas inlet;

assembling, inside the interior of the ion pump, the inserted components to form the blocking shield.

19. The method of embodiment 18, further comprising electrically connecting the blocking shield to a positively-biased voltage source.

20. The method of embodiment 18, further comprising electrically connecting the blocking shield to the at least one anode.

21. An ion pump comprising:

a housing enclosing an interior;

a gas inlet having a through-hole extending into the interior of the ion pump;

at least one cathode;

at least one anode positioned in proximity to the at least one cathode and having a longitudinal direction extending substantially normal to the at least one cathode;

a magnet disposed on an opposite side of the at least one cathode from the at least one anode; and a blocking shield disposed between the gas inlet and the cathode, comprising, a top member, a base for holding the blocking assembly, and a support connecting the top member to the base; and the top member having lateral and transverse extents which occlude the at least one cathode from a perspective of a through-hole of the gas inlet.

22. An ion pump comprising:

a housing enclosing an interior;

a gas inlet having a through-hole extending into the interior of the ion pump;

at least one cathode;

at least one anode positioned in proximity to the at least one cathode and having a longitudinal direction extending substantially normal to the at least one cathode;

a magnet disposed on an opposite side of the at least one cathode from the at least one anode; and a blocking shield disposed between the gas inlet and the cathode, and comprising, a top member, a base for holding the blocking assembly, and a support connecting the top member to the base; and a lateral width of the top member is greater than a lateral width of the base 23. An ion pump comprising:

a housing enclosing an interior;

a gas inlet having a through-hole extending into the interior of the ion pump;

at least one cathode;

at least one anode positioned in proximity to the at least one cathode and having a longitudinal direction extending substantially normal to the at least one cathode;

a magnet disposed on an opposite side of the at least one cathode from the at least one anode; and a blocking shield disposed inside the housing of the ion pump and comprising a top member, and a support connecting to the top member, wherein an underside of the top member connects to a vertically extending surface of the support such that the underside of the top member and the vertically are positioned to capture material sputtered from the cathode.

Testing with and Without Shield

The blocking shield of the invention has been tested in a standard 40 l/s ion pump operated with and without the blocking shield such as the one shown in FIG. 4. From modeling of the ion pump with the blocking shield, a reduction in pumping speed to 28 l/s was expected. Important for the testing was the elimination of charged particle emission from the ion pump.

Figure 9:
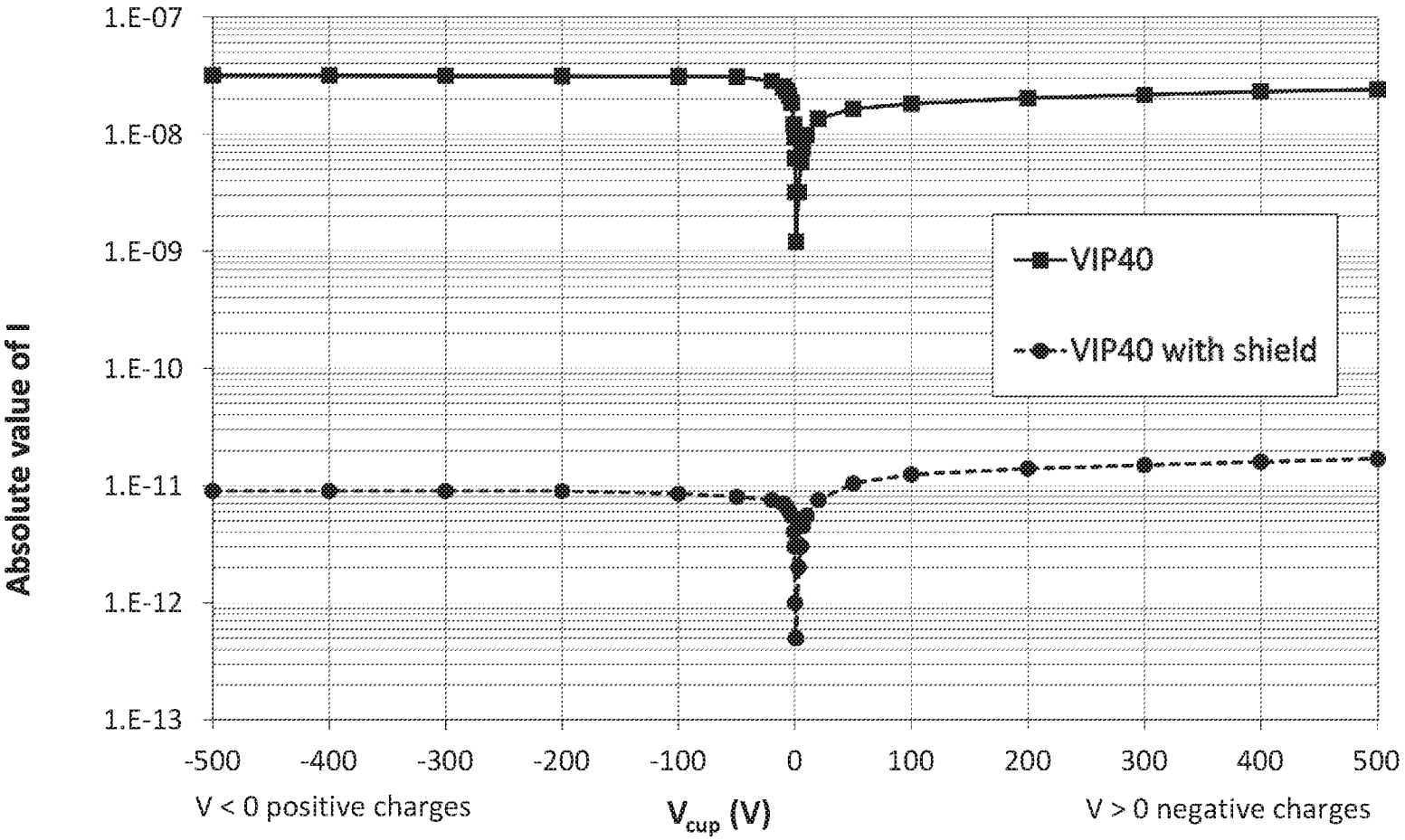
FIG. 9 is a depiction comparing the effectiveness of the blocking shield of the present invention to block charged particle emissions.

FIG. 9 shows plots of the measured charge particle collections 1) performance of the standard 40 l/s ion pump pumping under ultra-high vacuum conditions, and 2) the performance of the 40 l/s ion pump retrofitted with the blocking shield and also pumping under ultra-high vacuum conditions. The results shown in FIG. 9 show that the blocking shield is effective in stopping charged particle emission with approximately a three-order of magnitude reduction in charge particle emission when the shield is used as compared to no shield. Comparisons to other ion pumps show the blocking shield of the invention to be a better and simpler way to reduce charge particle emissions, with up to a 15× lower charge particle emission as compared to other commercial approaches for reducing charge particle emission.

Figure 10:
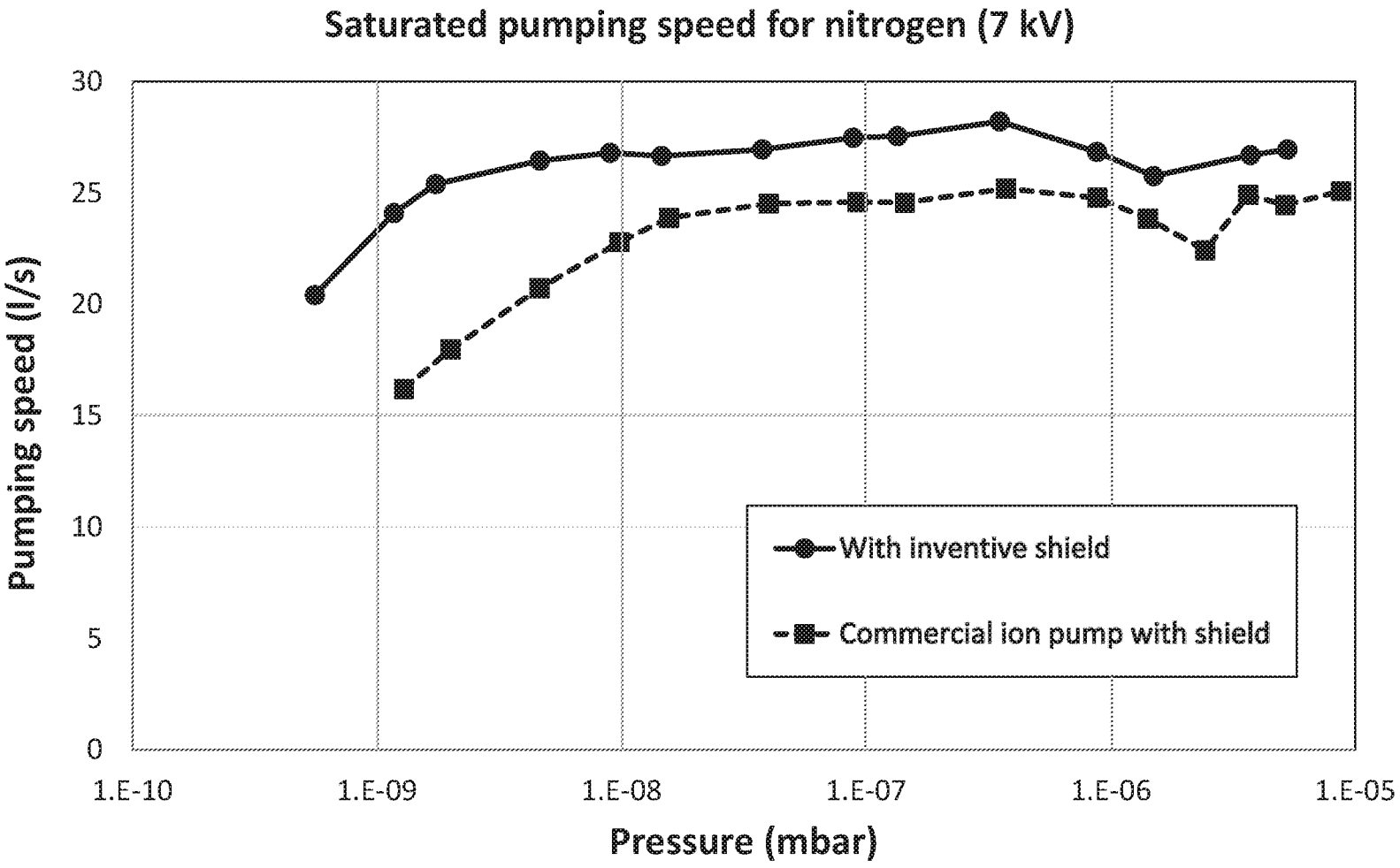
FIG. 10 is a depiction comparing the pumping speeds of a standard 40 l/s ion pump including the blocking shield of the invention to that of a commercial ion pump.

FIG. 10 show comparisons of pumping speed of an ion pump with the blocking shield and that of another commercial ion pump. The results against a measured flow of nitrogen gas show the pumping speed of the retrofitted ion pump to exceed that of the other commercial pumps.

Although the previous description only illustrates particular examples of various implementations, the invention is not limited to the foregoing illustrative examples. A person skilled in the art is aware that the invention as defined by the appended claims can be applied in various further implementations and modifications. In particular, a combination of the various features of the described implementations is possible, as far as these features are not in contradiction with each other. Accordingly, the foregoing description of implementations has been presented for purposes of illustration and description. It is not exhaustive and does not limit the claimed inventions to the precise form disclosed. Modifications and variations are possible in light of the above description or may be acquired from practicing the invention. It is therefore to be understood that within the scope of the appended claims, the invention may be practiced otherwise than as specifically described herein.

The invention claimed is:

1. An ion pump, comprising:

a housing enclosing an interior;

a gas inlet having a through-hole extending into the interior;

at least one cathode;

at least one anode; and a blocking shield positioned between the at least one cathode and the at least one anode on one side and the gas inlet on another side, the blocking shield comprising:

a top plate having an upper surface, and a support comprising a vertical wall vertically extending from the top plate at a distance from the at least one cathode, wherein the top plate and the vertical wall are both arranged to block particles traveling directly from the at least one cathode and/or the at least one anode to a through-hole of the gas inlet.

2. The ion pump of claim 1 wherein the top plate comprises a first top plate member and a second top plate member adjoining the first top plate member.

3. The ion pump of claim 1, wherein the blocking shield comprises a base, the support connects the top plate to the base, and a lateral width of the top plate is greater than a lateral width of the base.

4. The ion pump of claim 1, wherein an underside of the top plate connects to the support such that the underside of the top plate and the support are positioned to capture material sputtered from the cathode.

5. The ion pump of claim 1, wherein the blocking shield is configured to be positively biased.

6. The ion pump of claim 1, wherein the blocking shield is electrically connected to the at least one anode.

7. The ion pump of claim 1, wherein the blocking shield comprises an electrical-field shield deflecting particles emitted from the at least one cathode.

8. The ion pump of claim 1, wherein the blocking shield comprises a surface extending laterally or transversely in a plane without angular deviations from the plane.

9. The ion pump of claim 1, wherein the blocking shield extends in a plane substantially parallel to a longitudinal axis of the anode.

10. The ion pump of claim 1, wherein the blocking shield has a desk shape defined at least in part by the top plate and the support.

11. The ion pump of claim 1, wherein a lateral width of the top plate member is greater than a lateral width of the support.

12. A method for installing a blocking shield in an ion pump, the method comprising:

inserting components of the blocking shield through a gas inlet of the ion pump, the ion pump comprising a housing enclosing an interior, at least one cathode, and at least one anode, wherein the gas inlet comprises a through-hole extending into the interior, and the components have respective dimensions sized such that the components have clearance for passage through the through-hole; and assembling, inside the interior, the inserted components to form the blocking shield wherein, after the assembling:

the blocking shield is positioned between the at least one cathode and the at least one anode on one side and the gas inlet on another side; and the blocking shield comprises a top plate and a support, and the support comprises a vertical wall vertically extending from the top plate, and fixing the top plate and the vertical wall inside the ion pump such that both the top plate and the vertical wall are arranged to block particles traveling directly from the at least one cathode and/or the at least one anode to the through-hole of the gas inlet.

13. The method of claim 12, further comprising electrically connecting the blocking shield to a positively-biased voltage source.

14. The method of claim 12, further comprising electrically connecting the blocking shield to the at least one anode.

* * * * *